US007430879B2

(12) United States Patent
Czajka et al.

(10) Patent No.: US 7,430,879 B2
(45) Date of Patent: Oct. 7, 2008

(54) ADJUSTABLE SIZE RING

(75) Inventors: Edward Czajka, Brooklyn, NY (US); Hakob Melkonyan, Fort Lee, NJ (US)

(73) Assignee: Hearts On Fire Company, Boston, MA (US)

( * ) Notice: Subject to any disclaimer, the term of this patent is extended or adjusted under 35 U.S.C. 154(b) by 103 days.

(21) Appl. No.: 11/040,490

(22) Filed: Jan. 21, 2005

(65) Prior Publication Data

US 2006/0162380 A1 Jul. 27, 2006

(51) Int. Cl.
*A44C 9/02* (2006.01)

(52) U.S. Cl. ..... 63/15.6; 63/15.5

(58) Field of Classification Search ..... 63/15.5, 63/15.6, 15.65, 15.7, 15.4
See application file for complete search history.

(56) References Cited

U.S. PATENT DOCUMENTS 2,615,314 A * 10/1952 Axel ..... 63/15.6
2,745,265 A * 5/1956 Grafstein ..... 63/15.6
2,778,207 A * 1/1957 Thaler ..... 63/15.6
RE25,163 E 4/1962 Manne
3,423,956 A * 1/1969 Manne ..... 63/15.45
3,460,355 A 8/1969 Lodrini
3,460,356 A * 8/1969 Lodrini ..... 63/15.6
3,590,598 A * 7/1971 Leone ..... 63/15.6
3,933,010 A 1/1976 Ulbrich
4,245,485 A 1/1981 Bushong
4,471,634 A * 9/1984 Kaplan ..... 63/15.6
5,412,956 A 5/1995 Levy
5,636,531 A * 6/1997 Miller ..... 63/15.6
5,943,882 A 8/1999 Erb
6,003,334 A * 12/1999 Miller ..... 63/15.5
6,481,244 B1 11/2002 Wright
6,748,764 B1 * 6/2004 Roemer ..... 63/15.65

FOREIGN PATENT DOCUMENTS

JP 01-034301 2/1989

OTHER PUBLICATIONS

Office Action issued in copending related U.S. Appl. No. 11/229,055, mailed Jan. 22, 2008.
Supplementary European Search Report issued in counterpart European Application No. Ep 06 71 8726, mailed Feb. 4 2008.
English language abstract of JP 01-034301, published Feb. 3, 1989.

* cited by examiner

*Primary Examiner*—Victor Batson
*Assistant Examiner*—David C Reese
(74) *Attorney, Agent, or Firm*—DLA Piper US LLP

(57) ABSTRACT

An adjustable ring according to one embodiment of the present invention includes a ring portion having an outer surface and an inner surface defining an opening for receiving a finger therethrough; a movable segment coupled to the ring portion and movable between a first position and a second position; and a spring element coupled to the ring portion and the movable segment to allow movement of the movable segment between the first position and the second position. According to another embodiment of the present invention, the adjustable ring further includes an insert portion coupled to an inner surface of the ring portion, the insert portion having an opening; and the movable segment coupled to the insert portion and having a surface movable through the insert portion opening.

6 Claims, 9 Drawing Sheets

ADJUSTABLE SIZE RING

FIELD OF THE INVENTION

The present invention is directed to an improvement in jewelry and a method for making the same, and more specifically relates to an item of jewelry, preferably a ring or a bracelet suitable for wearing over a person's finger or wrist, having a spring actuated size adjustment mechanism.

BACKGROUND OF THE INVENTION

Determining a person's ring size is often a difficult proposition because ring sizes vary over time. For example, while an individual might be measured for a given ring size when purchasing a ring on a particular day, various factors ultimately affect a person's actual ring size on a given day. For example, various physiological conditions are known to affect ring size. A person's fingers might swell as a result of hormonal changes or water retention. Water retention might be exacerbated by other factors such as the amount of salt intake as part of a person's diet. Weight gain and weight loss over a period of time also affect a person's ring size. Even weather conditions on a given day may affect ring size. Additionally, often a person's knuckles are greater in size than the person's ring size. As a result, it is often difficult to get a properly sized ring placed over a person's knuckle.

As a result of some or all these factors, a person's ring size may vary greatly from one day to the next, from one season to the next, and from one year to the next. Since people often purchase jewelry to be worn frequently, or even daily, over a large period of time, these changes in ring size have proven to be annoying, costly and extremely problematic. For example, if a person's ring is too tight on a given day, the person might not be able to place the ring on his or her finger that day and might be forced to leave it at home. This is very annoying to a person who purchased the ring to wear every day, or who merely wanted to wear the ring on that particular day. Similar problems may arise if the ring is too loose on a given day and a person is forced to leave the ring at home or alternatively risk losing the ring if it falls off the person's finger unexpectedly.

Various methods have been developed to address this problem in the past. One common method, mentioned above, is to not wear a piece of jewelry that is too tight or too loose on a particular day. This is not practical or ideal for a person who purchased the jewelry to wear on a daily basis or who merely wanted or needed to wear the item of jewelry on that day. Another common method is to purchase jewelry (either the same item or different items) having different sizes. In that way, if a person's fingers were to swell or contract on a given day, the person could merely substitute a different sized ring on that day. However, this solution is extremely impractical and costly for most individuals to utilize.

Another common solution is to go to a jeweler and have the ring re-sized. While this option is frequently used, it too presents a number of problems. Enlargement of a ring can be accomplished in various ways. One way is through mechanical stretching, such as by placing the ring on a mandrel and striking it with a mallet to enlarge the opening. This can only be done if the amount of stretching required is small. Another, more intrusive way is to insert an extra piece of metal into the band. The insertion of additional material is more costly, may introduce imperfections into the metal, and often results in seams or areas of the ring that don't match. No matter how sophisticated the jeweler or the tools used, any stretching stresses the metal and there is always a risk of the ring snapping. Moreover, there is a limit to how far a ring can be stretched. Further, where stones are included in the ring, the stones must often be removed before the stretching can take place. Any time the stones are removed there is a risk of damage and/or loss.

Sizing down a ring can also be accomplished in a variety of ways. Where the change is small, the size can be made smaller by mechanically compressing the ring. If the ring is made of several metals (such as white and yellow gold), compression is typically not used as it might result in breaking the two metals apart. Where the change of size is greater, or where stones are included in the ring, sizing down the ring requires removing any stones, cutting out a portion of the ring, and then re-soldering the remaining portions together. This method is more costly and provides a greater risk of damaging the ring.

There are a number of problems with using a jeweler to re-size a ring. While this method is often useful for infrequent and small size adjustments, it is still costly and time consuming. Most importantly, it is completely impractical for addressing the day to day variations in ring size that most people typically encounter. For example, it would be almost useless to size a ring up a quarter size one day because a person's fingers are swollen, only to size it back down a few days later when the person's fingers return to a less swollen state.

Various adjustable size rings are also described in the prior art. For example, U.S. Pat. No. 5,412,956 to Levy, which is incorporated herein by reference, discloses a variable sized hinged ring that may be worn in a closed position or in a number of open positions. The ring includes a center shank member and first and second side shank members, each of which is hinged to the center shank member and an elongated sizing section that has a plurality of stops for determining the circumferential ring size. Thus, the ring can be opened and closed by the wearer to provide several different ring sizes. One problem with this system is that it can only accommodate the ring sizes corresponding to the stops provided. Another problem is that is must be manually opened and closed by the user. Further, once the ring size is expanded, the interior surface of the ring no longer presents a smooth, uninterrupted surface to the wearer and is thus very uncomfortable to wear. Additionally, once the ring size is expanded, the finger opening no longer has a generally constant shape and therefore the appearance to the user and others is much less attractive than a standard shaped ring.

Another ring adjustment mechanism is disclosed in U.S. Pat. No. 5,943,882 to Erb, which is incorporated herein by reference. Erb discloses a self sizing adjustable ring including a U-shaped shank member and a bridge member permanently connected to the shank member but movable up and down the shank member to adjust for the size of a user's fingers. The bridge member is manually adjustable by the user over a variety of different positions and is held in place using a frictional force created between the bridge and the shank member. One problem with this system is that it can only be used with U-shaped ring bodies. Another problem is that the bridge member is kept in place using frictional forces. It would be quite easy for the bridge member to disengage and move unintentionally. Additionally, the disclosed ring design requires a securement member attached to the bridge member to frictionally engage the exterior surface of the shank member. This results in an unattractive appearance to the user and others because the disclosed ring does not provide the appearance of an ordinary ring.

Yet another ring adjustment mechanism is disclosed in U.S. Pat. No. 6,003,334 to Miller, which is incorporated herein by reference. Miller discloses a finger ring size adjusting device and method including a ring shank and a cradle which is biased radially inward from the shank and is moveable between a retracted position and an adjusted position for reducing ring size. The cradle may be biased inwardly toward the adjusted position by a leaf spring in one embodiment, and by a lever arm in an alternate embodiment. One problem with this system is that the disclosed system includes only one cradle at the bottom of the ring shank. Only two possible ring sizes are provided—a smaller ring size and a larger ring size. There is no accommodation of a variety of ring sizes. Additionally, when the cradle is in its inward position, the ring does not provide a unitary, smooth, generally round inner surface. The inner surface would include gaps in which a user's skin could become pinched. Moreover, the appearance of the ring is less attractive as the lever or spring is visible through the opening in the ring.

Despite the various ring adjustment systems and methods known in the art, there still remains a need for a ring having a size that can be adjusted simply and easily by the wearer to account for day to day fluctuations in a person's ring size and to account for variations in finger size such as those caused by a larger knuckle region. There also remains a need for an adjustable ring that can accommodate a variety of different ring sizes within a specified range. Additionally, there is a need for an adjustable ring such that a jeweler can stock rings in fewer sizes.

SUMMARY OF THE INVENTION

One embodiment of the present invention is directed to an adjustable ring comprising a ring portion having an outer surface and an inner surface defining an opening for receiving a finger therethrough; an insert portion coupled to the inner surface of the ring portion, the insert portion having an opening; a movable segment coupled to one of the insert portion and the ring portion, the movable segment having a surface movable through the insert portion opening between a first position and a second position; and a spring element coupled to the movable segment and the ring portion to allow movement of the movable segment between the first position and the second position.

Another embodiment of the present invention is directed to an adjustable bracelet comprising a bracelet portion having an outer surface and an inner surface defining an opening for receiving a wearer's wrist therethrough; an insert portion coupled to the inner surface of the ring portion, the insert portion having an opening; a movable segment coupled to one of the insert portion or the ring portion, the movable segment having a surface movable through the insert portion opening between a first position and a second position; and a spring element coupled to the movable segment and the bracelet portion to allow movement of the movable segment between the first position and the second position.

Another embodiment of the present invention is directed to an adjustable ring comprising a ring portion having an outer surface and an inner surface defining an opening for receiving a finger therethrough; a movable segment hingably connected to the ring portion and movable between a first position and a second position; and a spring element coupled to the ring portion and the movable segment to allow movement of the movable segment between the first position and the second position.

Yet another embodiment of the present invention is directed to an adjustable bracelet comprising a bracelet portion having an outer surface and an inner surface defining an opening for receiving a wrist therethrough; a movable segment hingably connected to the bracelet portion and movable between a first position and a second position; and a spring element coupled to the bracelet portion and the movable segment to allow movement of the movable segment between the first position and the second position.

Yet another embodiment of the present invention is directed to an adjustable ring comprising a ring portion having an outer surface and an inner surface defining an opening for receiving a finger therethrough; a movable segment coupled to the ring portion and movable between a first position and a second position; and a spring element coupled to the ring portion and the movable segment to allow movement of the movable segment between the first position and the second position.

Yet another embodiment of the present invention is directed to an adjustable bracelet comprising a bracelet portion having an outer surface and an inner surface defining an opening for receiving a wrist therethrough; a movable segment coupled to the bracelet portion and movable between a first position and a second position; and a spring element coupled to the bracelet portion and the movable segment to allow movement of the movable segment between the first position and the second position.

BRIEF DESCRIPTION OF THE DRAWINGS

A preferred embodiment of the invention as well as alternate embodiments are described by way of example with reference to the accompanying drawings in which like numbers correspond to like elements, and in which.

DETAILED DESCRIPTION OF THE PREFERRED EMBODIMENTS

Figure 1A:
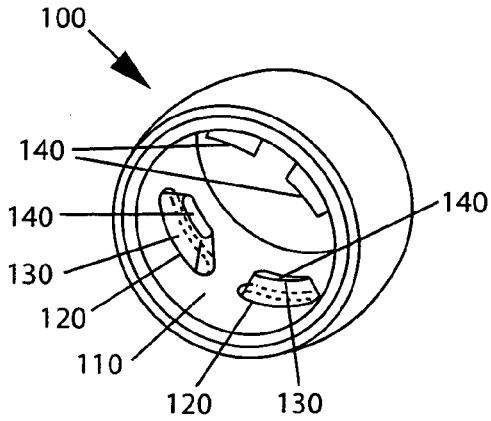
FIG. 1*a* is a perspective view of an adjustable ring according to one embodiment of the present invention illustrating a plurality of movable segments movable between a first position and a second position.
Figure 1B:
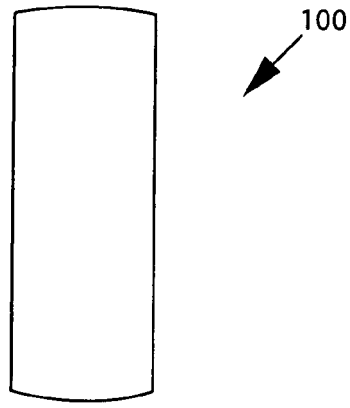
FIG. 1*b* is a front elevational view of the ring shown in FIG. 1*a;*
Figure 1C:
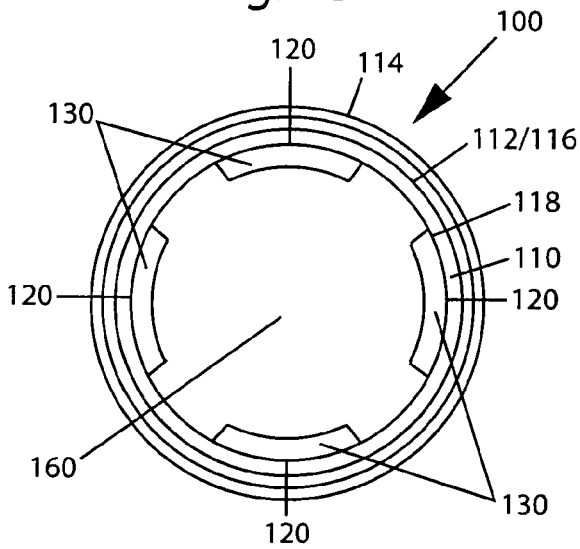
FIG. 1*c* is a side elevational view of the ring shown in FIG. 1*a;*

The following description is provided to enable those skilled in the art to make and use the present invention and sets forth the best mode contemplated by the inventors for carrying out their invention. Various modifications will be readily apparent to those skilled in the art and this invention may be embodied in many different forms and should not be construed as limited to the embodiments set forth herein. Thus, these embodiments are provided by way of example only.

Referring now initially to FIGS. 1*a*-1*e*, one embodiment of an adjustable ring according to the present invention is shown. The ring includes a ring body 100 having an opening 160 for receiving a finger therethrough. The size of the opening 160 corresponds to the ring size. The ring body 100 includes an outer surface 114 and an inner surface 112. Preferably, the inner and outer surfaces 112, 114 have a generally circular or arcuate shape and form a generally cylindrical body. The outer surface 114 may include any manner of design or decoration and may include one or more jeweled stones, such as diamonds, mounted thereon. The outer and inner surfaces define a thickness (t) of the ring body 100, which can be selected as desired as is known in the art. The ring body 100 may be formed of any of a variety of materials, such as gold or silver, or any combination of materials, such as white and yellow gold. The ring body 100 may be formed in any of a variety of sizes by varying the diameter (d, d+t) of the inner and outer surfaces 112, 114, respectively, the thickness (t) and the width (w) of the ring body 100.

The adjustable ring according to this first embodiment also includes an insert portion 110. The insert portion 110 may be formed of a variety of materials but is preferably formed of the same material as the ring body 100. The insert portion 110 preferably has the same width (w) as the ring body 100, but a slightly smaller diameter so that it may be placed inside of the inner surface 112 of the ring body 100. Alternatively, a smaller width (w) may be selected. According to one aspect of the invention, the insert portion 110 is press fit into the ring body 100 so that it remains firmly in place. According to another aspect of the invention, the insert 110 may be integrally formed with the ring body 100. Additionally, according to one aspect of the invention, the inner surface 112 of the ring body may include a grooved region or channel (not shown) into which the insert 110 may be placed. The insert portion 110 includes an outer surface 116 which cooperates with the inner surface 112 of the ring body, and an inner surface 118. The insert portion 110 includes at least one opening 120 through which a movable segment 130 can move, although a plurality of openings 120 can be incorporated. According to one aspect of the invention, the insert portion 110 includes four openings 120 such that one of four movable segments can move through each of the openings 120.

Figure 1D:
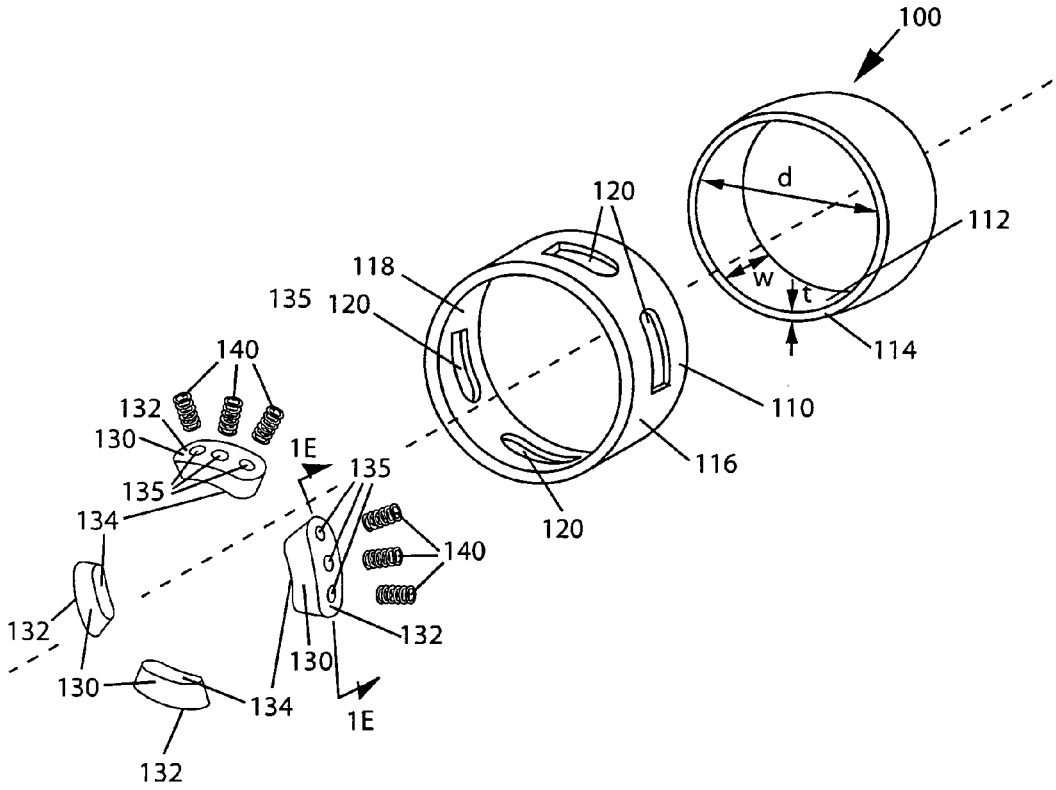
FIG. 1*d* is an exploded perspective view of the ring shown in FIG. 1*a;*
Figure 1E:
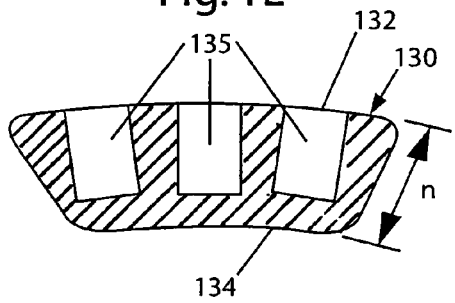
FIG. 1*e* is a cross-sectional side view of the movable segment shown in FIG. 1*d;*
Figure 2A:
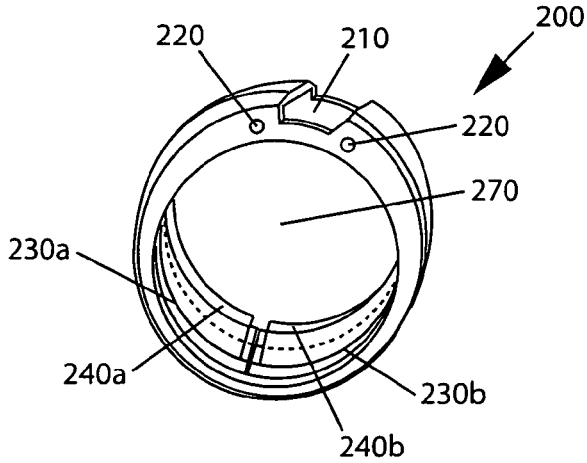
FIG. 2*a* is a perspective view of an adjustable ring according to another embodiment of the present invention illustrating a plurality of movable segments movable between a first position and a second position.
Figure 2B:
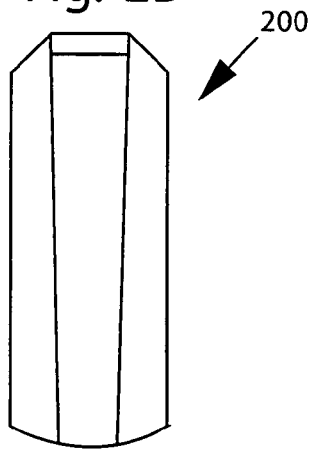
FIG. 2*b* is an elevational front view of the ring shown in FIG. 2*a;*
Figure 2C:
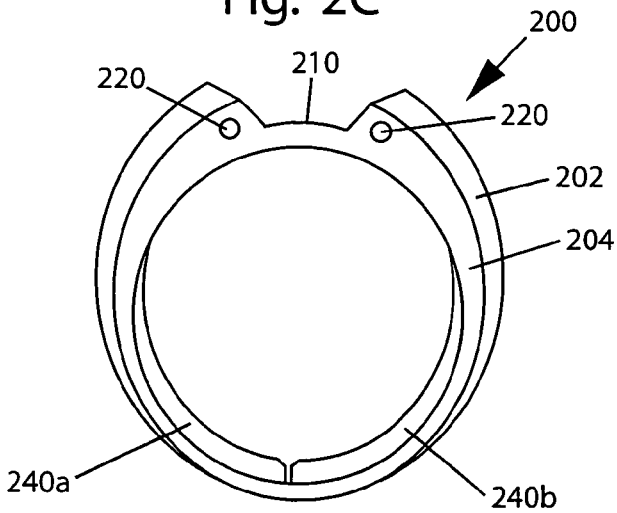
FIG. 2*c* is an elevational side view of the ring shown in FIG. 2*a;*
Figure 2D:
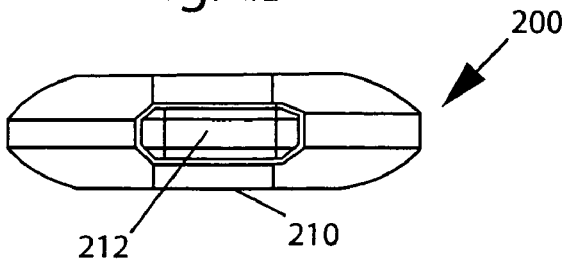
FIG. 2*d* is a top view of the ring shown in FIG. 2*a;*
Figure 2E:
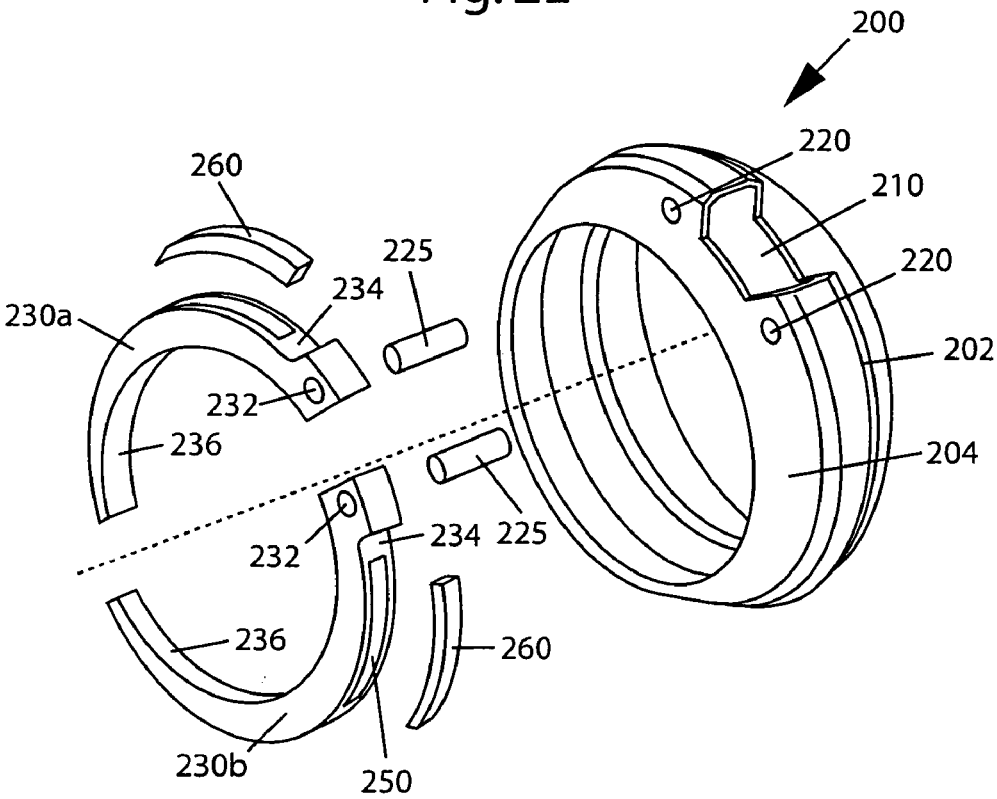
FIG. 2*e* is an exploded perspective view of the ring shown in FIG. 2*a;*
Figure 2F:
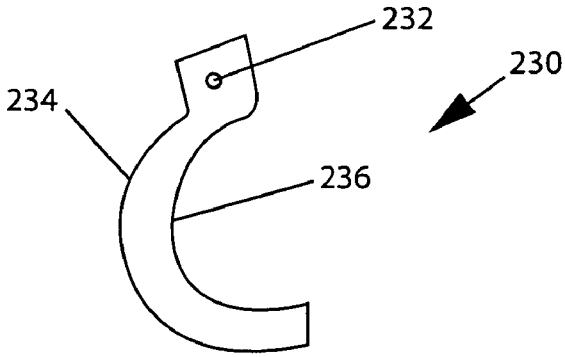
FIG. 2*f* is a side view of the movable segment shown in FIG. 2*e;*

The adjustable ring according to this first embodiment also includes one or more movable segments 130. As discussed above, according to one aspect of the invention, the adjustable ring includes four movable segments 130, each of which is movable through a respective opening 120 in the insert portion, such that the segments 130 can move between a first position and a second position. The movable segments 130 include an outer surface 132 and an inner surface 134, the inner surface 134 contacting the finger of the wearer. The outer surface 132 of the movable segment is coupled to one or more spring elements 140 to allow movement of the movable segment 130. Preferably, the outer surface 132 of the movable segments include one or more nesting regions 135 in which the spring elements 140 may be placed. The nests 135 preferably extend partially, but not fully, through the body of the movable segment 130, so that the spring element 140 can be seated within the movable segment 130. Preferably, the spring elements 140 are compression springs, although any type of appropriate spring may be used. The spring elements 140 should provide enough tension so that the ring is firmly secured to the user's finger using the movable segments 130 irregardless of the position at which the movable segments 130 are located. According to one aspect of the invention, as shown in FIGS. 1*d* and 1*e*, each movable segment 130 includes three nests 135, each of which houses an individual spring element 140.

According to a preferred aspect of the first embodiment, the outer surface 132 of the movable segment is larger than the inner surface 134 so that the outer surface 132 does not pass through the opening 120 of the insert portion 110 under tension from the spring elements 140 and during movement of the movable segment 130. In this way, the movable segments 130 are secured in place. However, any other suitable method of securing the movable segments 134 within the adjustable ring may instead be used.

In use, and before the user places the adjustable ring on the user's finger, the spring elements 140 are preferably uncompressed and in their natural state such that the inner surfaces 134 of the movable segments protrude through the openings 120 in the insert portion 110 to a first position 140. At this first position 140, the movable segments 130 create a reduced opening for the user's finger. As the user places the adjustable ring on his or her finger, the finger compresses the spring elements 140 and the movable segments 130 move outwardly to a second position, thus creating a expanded opening to fit over the user's finger. In this way, the compression and expansion of the spring elements 140 provide for an adjustable sized opening for the user's finger. Preferably, the movable segments 130 can move among a plurality of positions, thus accommodating a range of openings (i.e., ring sizes), limited principally by the height (h) of the movable segments 130 and the diameter of the ring portion 100. Preferably, movable segments 130 having a height of approximately ½ mm are used, thus providing a range of one ring size (e.g., between size 8 and 9, or between size 5½ and 6½).

Referring now to FIGS. 2*a*-2*f*, a second embodiment of an adjustable ring according to the present invention is shown. The ring includes a ring body 200 having an opening 270 for receiving a finger therethrough. The ring body 200 includes a mounting region 220 to which a movable segment 230 may be hingably connected. The ring body 200 includes an outer surface 202 and an inner surface 204. Preferably, the outer and inner surfaces 202, 204 have a generally circular or arcuate shape and form a generally cylindrical body. According to one aspect of the invention, the inner surface 204 may include a channel or grooved region (not shown) into which the movable segment 230 may be recessed.

The outer surface 202 may include any manner of design or decoration and may include one or more jeweled stones, such as diamonds, mounted thereon. The outer surface 202 may include an insert region 210 having a mounting section 212 onto which a jeweled stone may be mounted. The outer and inner surfaces 202, 204 define a thickness (t) of the ring body 200, which can be selected as desired as is known in the art. Similar to the first embodiment, the ring body 200 may be formed of any of a variety of materials and may be formed in any of a variety of sizes.

The adjustable ring according to this second embodiment further includes one or more movable segments 230. Preferably, two movable segments are included, one on each side of the ring 230. The movable segments 230 include an outer surface 234 and an inner surface 236, both of which are preferably arcuate shaped. The movable segments 230 further include a hinge area 232 through which the movable segments 230 are hingably connected to the ring body 200. Preferably, the movable segments 230 are hingably connected to the ring body 200 at the mounting region 220 using pins 225. However, any other known method of hingably connecting these components may instead be used.

The adjustable ring according to this second embodiment further includes one or more spring elements 260. Preferably, two spring elements are used, one coupled to each of the two movable segments 230. According to one aspect of the invention, the outer surface 234 of the movable segments includes a slot, channel or groove 250 into which the spring element 260 can be placed. While any of a variety of types of springs may be used for the spring element 260, flat or wire springs are preferable.

In use, and before the user places the adjustable ring on the user's finger, the spring elements 260 are preferably uncompressed and in their natural state such that the movable segments 230 protrude into the ring opening 270 to a first position 240 *a, b* to create a reduced open area for the user's finger. Alternatively, the spring elements 260 may always be in some state of compression. The amount of protrusion of the movable segments 230 into the ring opening is selected to create the desired amount of variation in the size of the ring opening. As the user places the adjustable ring on his or her finger, the finger compresses the spring elements 260 and the movable segments 230 move outwardly to a second position 230 *a, b*, thus creating a expanded opening to fit over the user's finger. In this way, the compression and expansion of the spring elements 260 provide for an adjustable size opening for the user's finger. Preferably, the movable segments 230 can move among a plurality of positions, thus accommodating a range of openings (i.e., ring sizes).

Figure 3A:
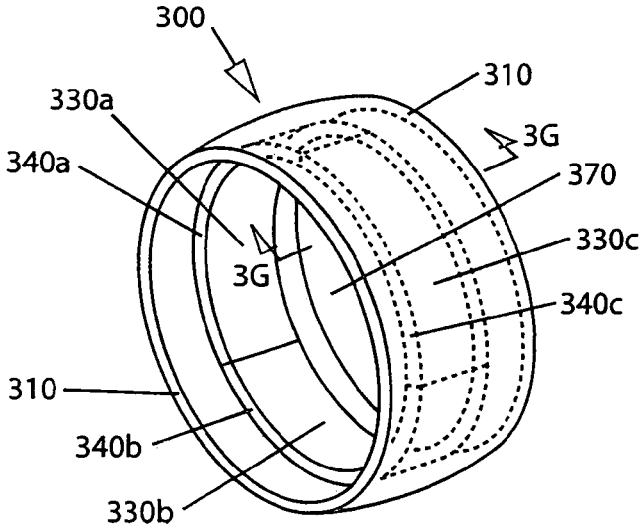
FIG. 3*a* is a perspective view of an adjustable ring according to yet another embodiment of the present invention illustrating a plurality of movable segments movable between a first position and a second position.
Figure 3B:
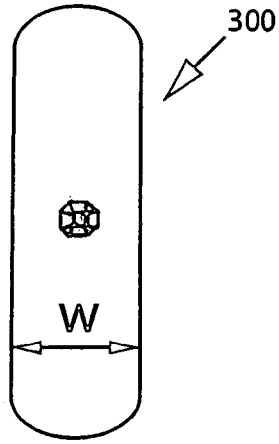
FIG. 3*b* is a front elevational view of the ring shown in FIG. 3*a;*
Figure 3C:
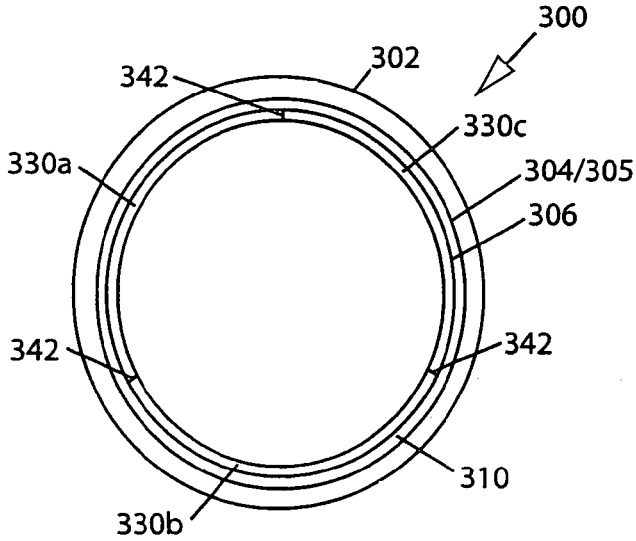
FIG. 3*c* is a side elevational view of the ring shown in FIG. 3*a;*
Figure 3D:
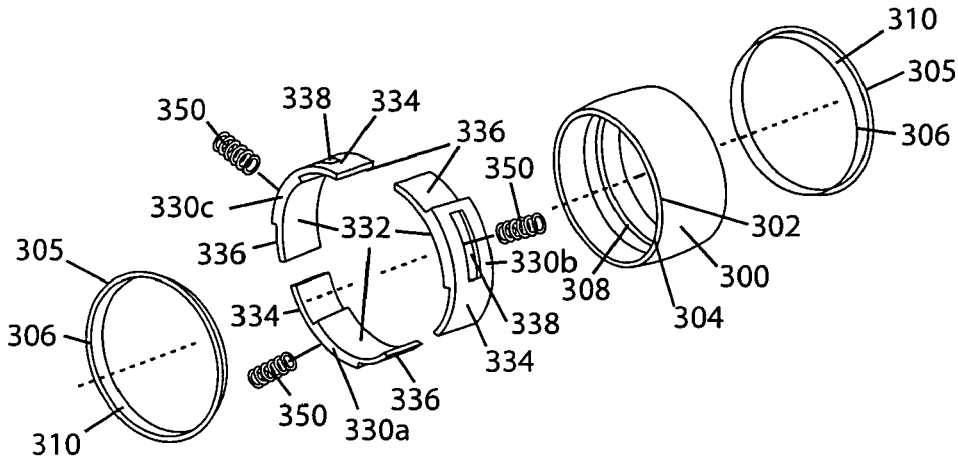
FIG. 3*d* is an exploded perspective view of the ring shown in FIG. 3*a;*
Figure 3E:
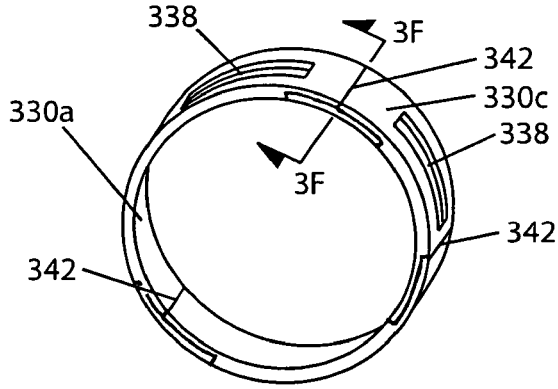
FIG. 3*e* is a perspective view of the movable segments shown in FIG. 3*d;*
Figure 3F:
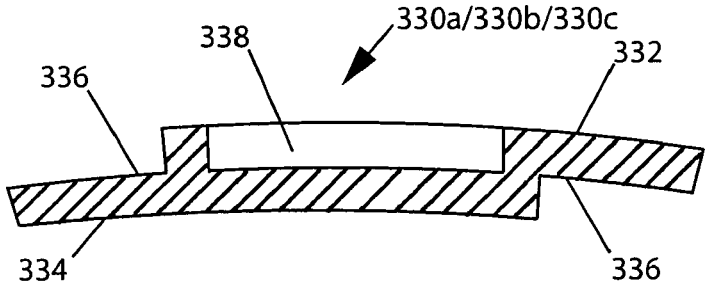
FIG. 3*f* is a cross sectional side view of a movable segment shown in FIG. 3*d;*
Figure 3G:
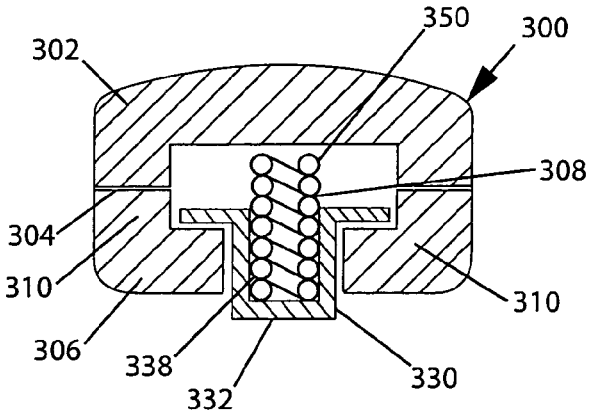
FIG. 3*g* is a cross sectional view taken through lines 1-1 of FIG. 3*a;*
Figure 4A:
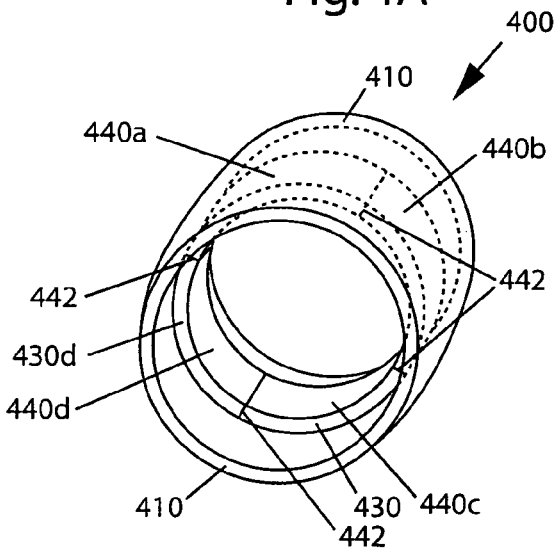
FIG. 4*a* is a perspective view of an adjustable ring according to yet another embodiment of the present invention illustrating a plurality of movable segments movable between a first position and a second position.
Figure 4B:
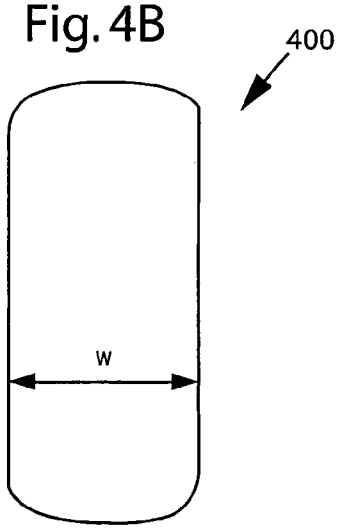
FIG. 4*b* is a front elevational view of the ring shown in FIG. 4*a;*
Figure 4C:
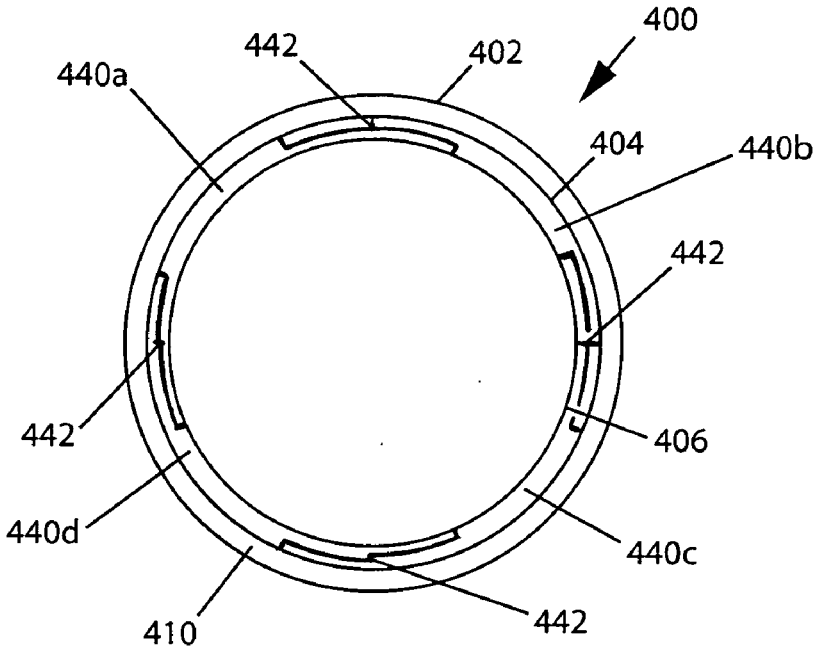
FIG. 4*c* is a side elevational view of the ring shown in FIG. 4*a;*
Figure 4D:
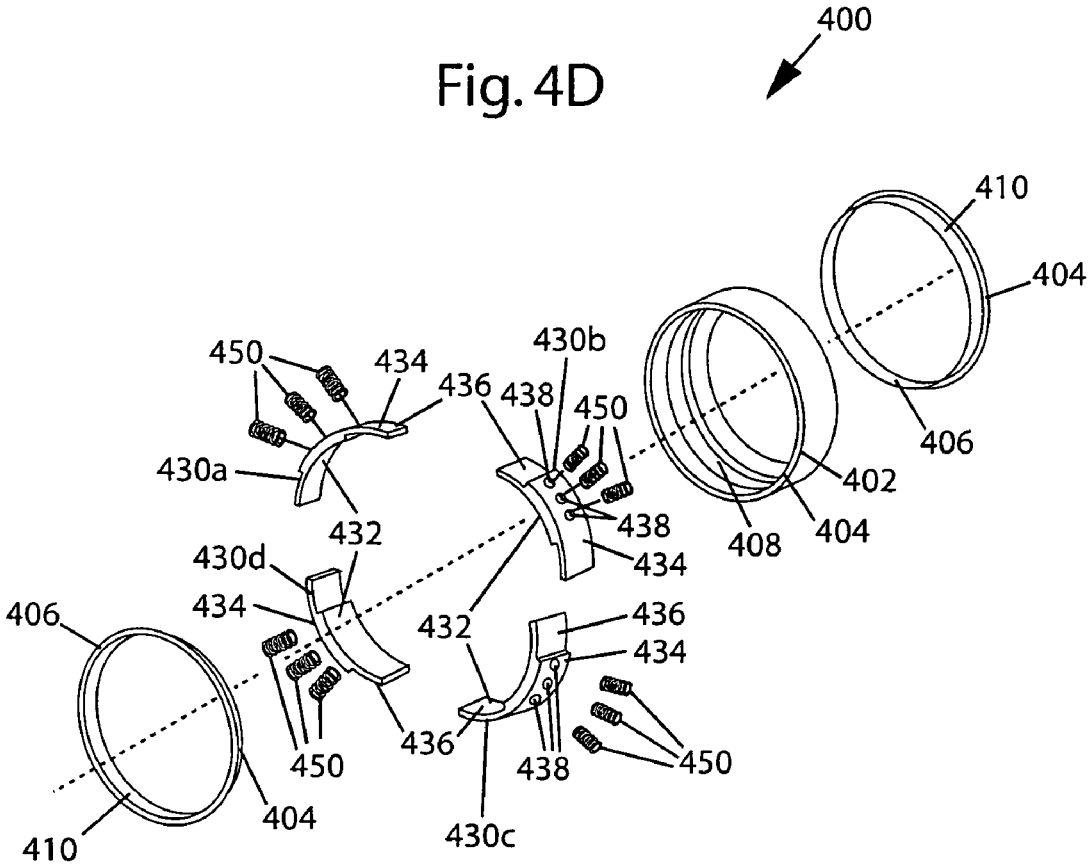
FIG. 4*d* is an exploded perspective view of the ring shown in FIG. 4*a;*
Figure 4E:
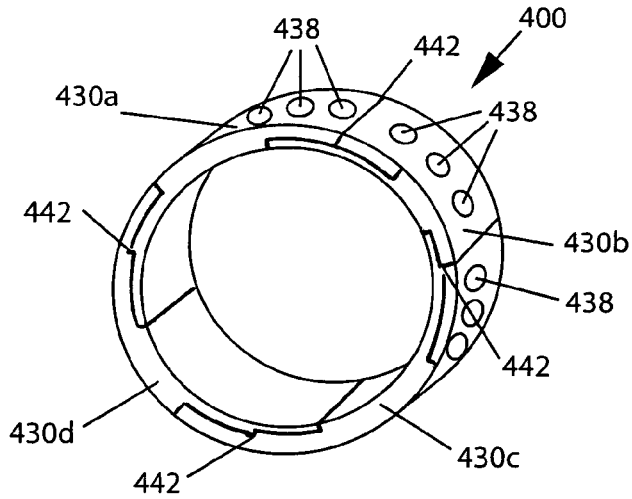
FIG. 4*e* is a perspective view of the movable segments shown in FIG. 4*d;*
Figure 4F:
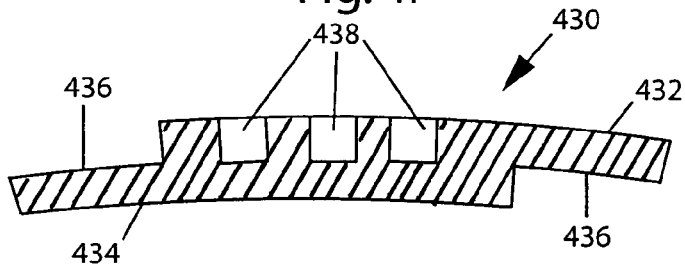
FIG. 4*f* is a cross sectional side view of a movable segment shown in FIG. 4*d*.
Figure 4G:
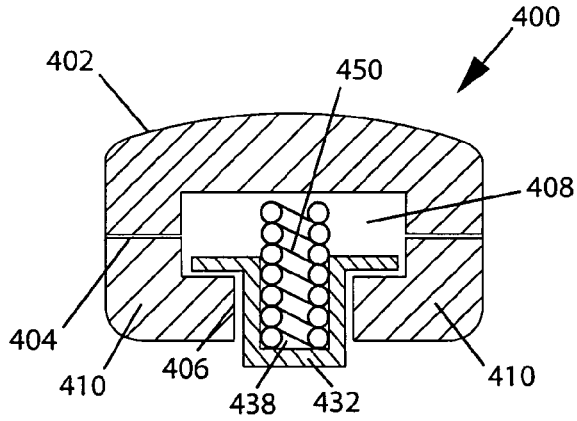
FIG. 4*g* is a cross sectional view taken through lines 2-2 of FIG. 4*a.*

Referring now to FIGS. 3*a*-3*g*, a third embodiment of an adjustable ring according to the present invention is shown. The ring includes a ring body 300 having an opening 370 for receiving a finger therethrough. The ring body 300 includes an outer surface 302 and an inner surface 304. Preferably, the inner and outer surfaces 302, 304 have a generally circular or arcuate shape and form a generally cylindrical body. According to one aspect of the invention, the inner surface 304 may include a channel or grooved region 308 into which the movable segment 330 may be placed. As described above, the outer surface 302 may include any manner of design or decoration, such as a jeweled stone as shown in FIG. 3*b*. Additionally, as described above, the ring body 300 may be formed of any of a variety of materials and may be formed in any of a variety of sizes.

According to one aspect of the third embodiment of the invention, the adjustable ring further includes a locking ring 310 that is coupled to the ring portion 300. Preferably, two locking rings 310 are used, one placed on each side of the ring. The locking ring 310 includes an outer surface 305 and an inner surface 306. The outer surface 305 of the locking ring 310 cooperates with the inner surface 304 of the ring body 300. Preferably, the locking ring 310 is press fit into the ring body 300. While the locking rings 310 have been described as separate components, they may alternatively be pre-formed into the ring body 300 itself. The use of a locking ring 310 in conjunction with the ring body 300 helps provide a retaining mechanism for the movable segment(s) 330 as is described further below.

The adjustable ring according to this third embodiment further includes one or more movable segments 330. Preferably, three movable segments are used. The movable segments 330 include an outer surface 334 and an inner surface 336, both of which are preferably arcuate shaped. The movable segments 330 preferably include an overlap region 336 such that the placement of one movable segment 330 next to another results in a smooth seam 342 being formed at the inner surfaces 332 of the movable segments 330. In this way, a smooth, comfortable, generally continuous inner ring surface is provided to the user. According to one aspect of the invention, the outer surface 334 of the movable segments 330 include a channel or grooved region 338 for receiving and housing a spring element 350.

The adjustable ring according to this third embodiment further includes one or more spring elements 350. Preferably, three spring elements are used, one coupled to each of the three movable segments 330. While any of a variety of types of springs may be used for the spring element 350, flat or wire springs are preferable.

The operation of the third embodiment of the present invention is similar to that described in connection with the earlier two embodiments. In use, and before the user places the adjustable ring on the user's finger, the spring elements 350 are preferably uncompressed and in their natural state such that the movable segments 330 protrude into the ring opening 370 to a first position 340 *a,b,c* to create a reduced open area for the user's finger. As the user places the adjustable ring on his or her finger, the finger compresses the spring elements 350 and the movable segments 330 move outwardly to a second position 330 *a, b, c* thus creating a expanded opening to fit over the user's finger. In this way, the compression and expansion of the spring elements 350 provide for an adjustable size opening for the user's finger. Preferably, the movable segments 330 can move among a plurality of positions, thus accommodating a range of openings (i.e., ring sizes).

A fourth embodiment of an adjustable ring according to the present invention is illustrated in FIGS. 4*a*-4*g*. This embodiment is similar in most respect to the third embodiment described above. The main difference is with regard to the movable segments 430. The fourth embodiment is preferably used in conjunction with a ring body 400 having a larger width (w), while the third embodiment is more preferably used in conjunction with a ring body 300 having a smaller width (w). The operation of this fourth embodiment is generally the same as that of the third embodiment. Thus, the adjustable ring according to the fourth embodiment preferably includes a ring portion 400 having an outer surface 402 and an inner surface 404, and preferably a groove or channel 408 in the inner surface 404. The adjustable ring also preferably includes two locking rings 410, one on each side of the ring body 400, which are preferably press fit into the ring body 400 to help retain the movable segments 430 in the ring. The adjustable ring further includes one or more spring elements 450, which, as contrasted with the third embodiment, are preferably coil or compression springs. According to one aspect of the invention, a plurality of spring elements 450 are used in connection with each of a plurality of movable segments 430.

The fourth embodiment includes a movable segment 430 having an outer surface 434, an inner surface 432, and preferably an overlap region 436. In this way, it is similar to the movable segment 330 described above in connection with the third embodiment of the invention. Preferably, four movable segments 430 are used, although any number can be chosen as desired. In contrast to the third embodiment movable segments 330, the movable segments 430 of the fourth embodiment of the invention preferably include one or more nesting regions 438 in the outer surfaces 434 of the movable segments 430. Preferably, each movable segment 430 includes three nesting regions 438. The nests 438 preferably extend partially, but not fully, through the body of the movable segment 430, so that the spring elements 450 can be seated within the movable segment 430. Preferably, each nest 438 houses a single corresponding spring element 450.

As described above, in connection with any of the disclosed embodiments, the outside surface of the adjustable ring of the present invention may be plain or it may be decorated in any desired way, all within the scope of the invention. Additionally, the ring portion may include one or more jeweled stones, such as a diamond, as is known in the art. Additionally, while the outer and inner surfaces of the ring portion have been described herein to be generally arc shaped, any shaped surfaces may be utilized within the present invention. For example, a flat shaped outer surface is often preferable in rings for men and where stones are to be mounted on top of the ring.

The adjustable ring of the present invention may be created in any of variety of sizes and may be caused to adjust within various size ranges. For example, while it is preferred to provide an adjustable size finger receiving opening that accommodates sizes within a range of 1 mm or approximately one ring size (most individuals would typically not have a need for larger size adjustments), the adjustment mechanism of the present invention may be modified to accommodate smaller (i.e., half size) or larger (i.e., two sizes) adjustment ranges.

Additionally, while the present invention has been generally described herein with respect to rings worn over a wearer's finger, the present invention applies equally to other types of jewelry, such as bracelets, where similar adjustments would be applicable and beneficial to a wearer. In this way, the disclosed adjustment mechanisms could be utilized in conjunction with a bracelet to provide a way for adjusting the diameter of the interior wrist-receiving opening of the bracelet. In this way, a wearer can place the bracelet over the hand and onto the wrist without having to open the bracelet, stretch the bracelet, or utilize a bracelet which is ultimately too large for the wearer's wrist. Similarly, the outside portion of the bracelet could then be decorated or designed in any desired way, all within the scope of the present invention.

While the invention has been described above with respect to certain embodiments thereof, it will be apparent to those skilled in the art that variations and modifications may be made without departing from the spirit and scope of the invention.

What is claimed is:

1. An adjustable jewelry ring comprising:

a ring portion having an outer surface and an inner surface defining an opening for receiving a finger therethough;

at least three movable segments coupled to the ring portion with each segment being radially movable along an entire length of the segment between a first position and a second position; and a plurality of spring elements corresponding to said at least three movable segments with each spring element being coupled to the ring portion and to one and only one of the movable segments to allow movement of the movable segments between the first position and the second position.

2. The ring according to claim 1, wherein the ring portion is generally cylindrical.

3. The ring according to claim 1, wherein the spring elements are one of a flat spring, a wire spring, a coil spring and a compression spring.

4. The ring according to claim 1, wherein the ring portion outer surface has one of a generally arcuate shape and a generally flat shape.

5. The ring according to claim 1, wherein the ring portion outer surface is decorated.

6. The ring according to claim 1, wherein the movable segments have an outer surface including one of a channel and a nesting region for receiving the spring elements.

* * * * *